US005822948A

United States Patent [19]

Manservigi et al.

[11] Patent Number: 5,822,948

[45] Date of Patent: Oct. 20, 1998

[54] PRODUCT MANIPULATING METHOD

[75] Inventors: Alberto Manservigi, Bologna; Fiorenzo Draghetti, Medicina, both of Italy

[73] Assignee: G.D Societa' per Azioni, Bologna, Italy

[21] Appl. No.: 851,444

[22] Filed: May 5, 1997

[30] Foreign Application Priority Data

May 6, 1996 [IT] Italy ..... BO96A0239

[51] Int. Cl.[6] ..... B65B 19/00

[52] U.S. Cl. ..... 53/466; 53/234

[58] Field of Search ..... 53/466, 461, 232, 53/233, 234, 253, 252, 251, 250, 249

[56] References Cited

U.S. PATENT DOCUMENTS 4,559,757 12/1985 Focke et al. ..... 53/234 X 4,823,536 4/1989 Manservigi et al. ..... 53/466

4,962,628 10/1990 Boldrini et al. ..... 53/466 X 4,999,970 3/1991 Bamrungbhuet et al. ..... 53/234 X 5,657,609 8/1997 Spada et al. ..... 53/234 X

FOREIGN PATENT DOCUMENTS 2191166 12/1987 United Kingdom .

*Primary Examiner*—James F. Coan

*Attorney, Agent, or Firm*—Ladas & Parry

[57] ABSTRACT

A method of manipulating products, each of which is transferred twice between a first and a second seat facing, parallel to, and opposite each other, to perform an operation on the product at each transfer; the two operations permitting, for example, the formation of a tubular wrapping about the product.

9 Claims, 5 Drawing Sheets

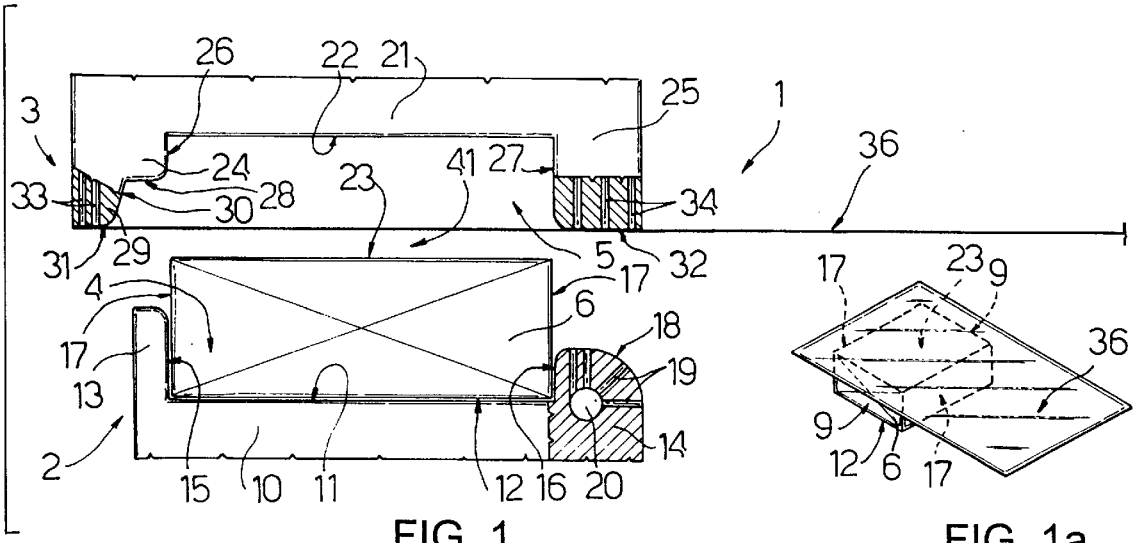
FIG. 1
FIG. 1a
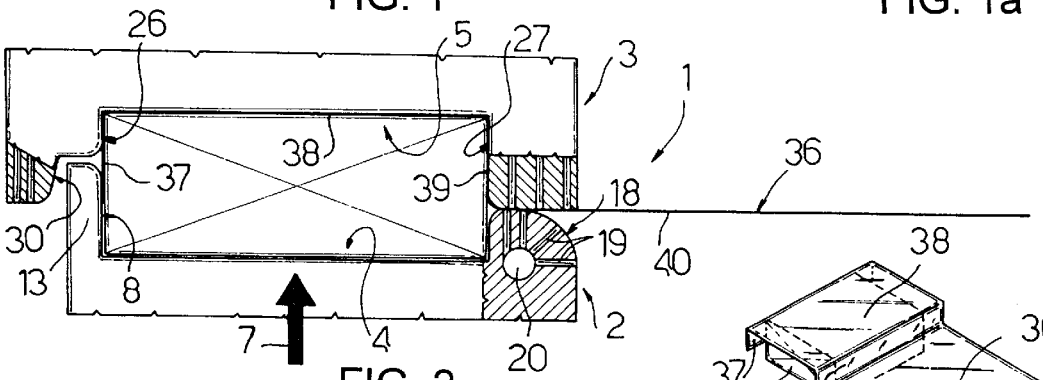
FIG. 2
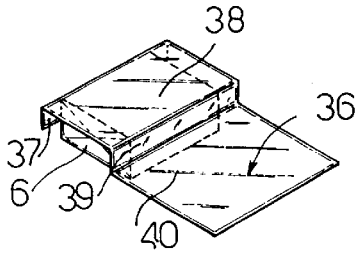
FIG. 2a
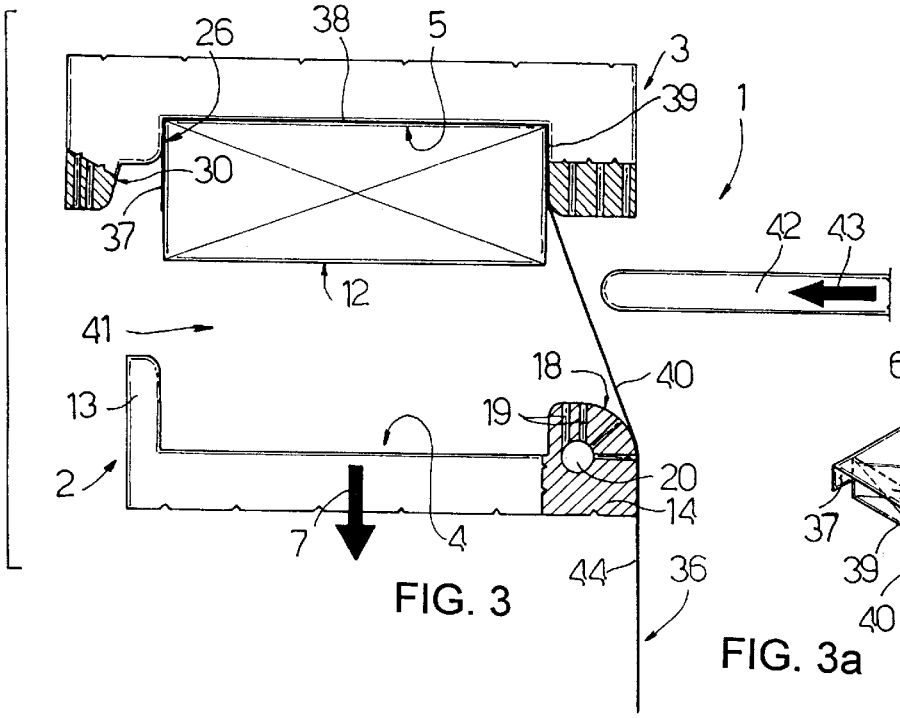
FIG. 3
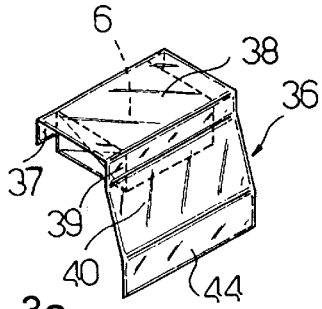
FIG. 3a

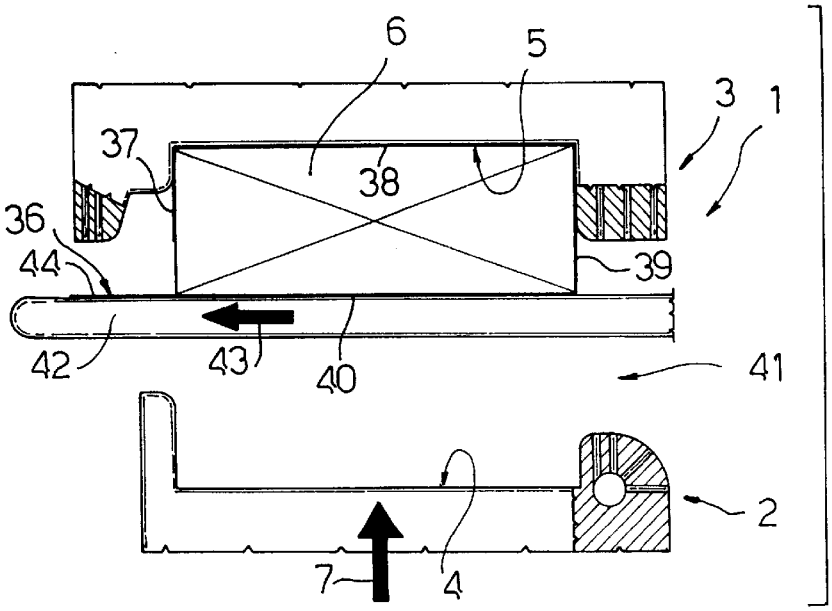
FIG. 4
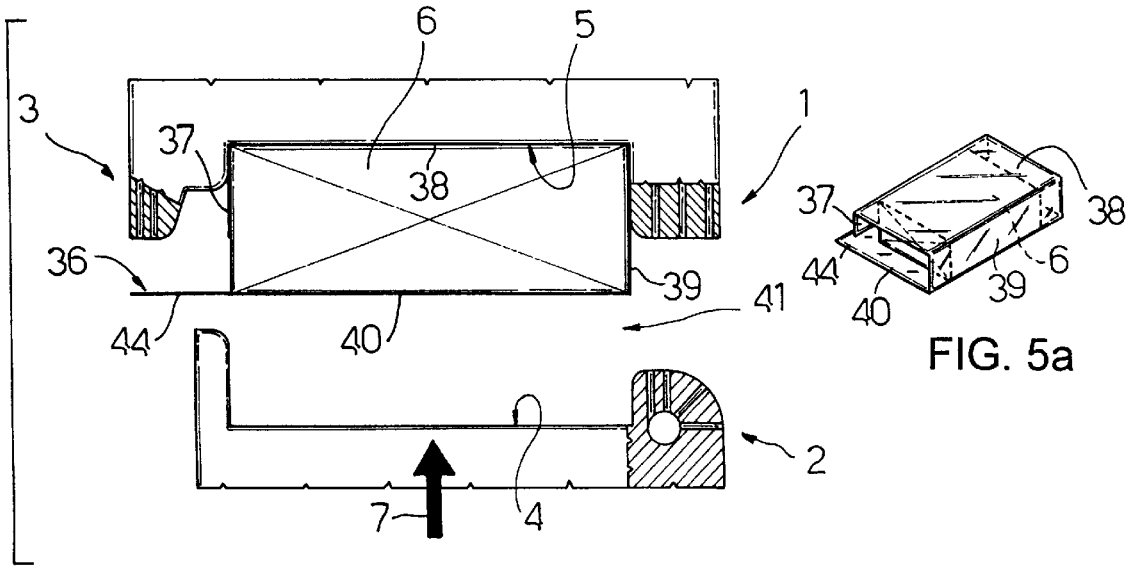
FIG. 5a
FIG. 5

PRODUCT MANIPULATING METHOD

BACKGROUND OF THE INVENTION

The present invention relates to a product manipulating method.

The present invention may be used to advantage in the tobacco industry, in particular for manipulating packets or cartons of cigarettes, to which the following description refers purely by way of example.

In general, operations are performed on packets of cigarettes as they are transferred between two corresponding seats of two conveyors movable along a common path. In European Patent Application n.509,293, for example, a sheet of wrapping material is inserted between a first and second seat facing each other and traveling at the same speed along a common path; the first seat is so formed as to at least partly receive a packet; and the second seat is so formed as to receive the packet and the sheet, which is folded into a U about the packet as the packet and sheet are inserted at least partly inside the second seat by moving the two seats towards each other, and possibly with the aid of pushers and counter-pushers.

Upon the first and second seats being parted so that the packet is retained by the second seat, the portion of the sheet projecting from the second seat is folded onto the packet by fixed folding members and by movable folding members normally pivoting on the first or second seat.

While affording the advantage of performing a sequence of operations during transfer of the product, the above solution involves several drawbacks on account of the folding members and respective actuating devices seriously complicating the structure of the seats, which are therefore difficult and expensive to produce.

Moreover, in view of the fact that the first and second seats form part of respective conveyors and, in addition to cooperating with each other to fold the wrapping material, also feed the packet at high speed along a given path, the folding members and respective actuating devices may impair the reliability of the conveyors.

Finally, by requiring that each packet be transferred from one conveyor to a follow-up conveyor for each operation performed on the packet, the above known solution necessarily requires the use of a number of cascade conveyors for performing a number of operations on each packet.

SUMMARY OF THE INVENTION

It is an object of the present invention to provide a manipulating method designed to overcome the aforementioned drawbacks.

According to the present invention, there is provided a method of manipulating products, the method comprising the steps of supporting a product by means of a first seat facing and parallel to a second seat, the two seats being set to a parted position; moving the two seats, in a first given direction, in relation to and towards each other into a mating position to transfer the product from the first to the second seat and, at the same time, perform a first operation on the product; retaining the product in the second seat; and moving the two seats in relation to each other so as to move the first seat away from the second seat and restore the two seats to the parted position; characterized by comprising the further step of moving the two seats in relation to each other and back into the mating position, so that the product is engaged by the first seat, to perform a second operation on the product.

The above method preferably comprises the further steps of transferring the product from the second to the first seat when the two seats are once more in the mating position; retaining the product inside the first seat; and moving the two seats back into the parted position.

Moreover, said two seats are preferably moved in a second direction, substantially perpendicular to said first direction, and along a substantially common path in the course of said relative displacements of the two seats and said two operations.

According to a preferred embodiment of the above method, said first and said second operation involve mating the product with at least one sheet element.

BRIEF DESCRIPTION OF THE DRAWINGS

A non-limiting embodiment of the present invention will be described by way of example with reference to the accompanying drawings, in which:

FIG. 1 shows a schematic side view, with parts in section and parts removed for clarity, of a manipulating unit implementing the method according to the present invention and in a first operating position;

FIG. 1*a* shows the product in the first operating position;

FIGS. 2 to 7 show the same view of the unit in FIG. 1 in further operating positions;

FIGS. 2*a*, 3*a*, 5*a*, and 6*a* show the product in respective further operation positions;

DETAILED DESCRIPTION OF THE INVENTION

Figure 6:
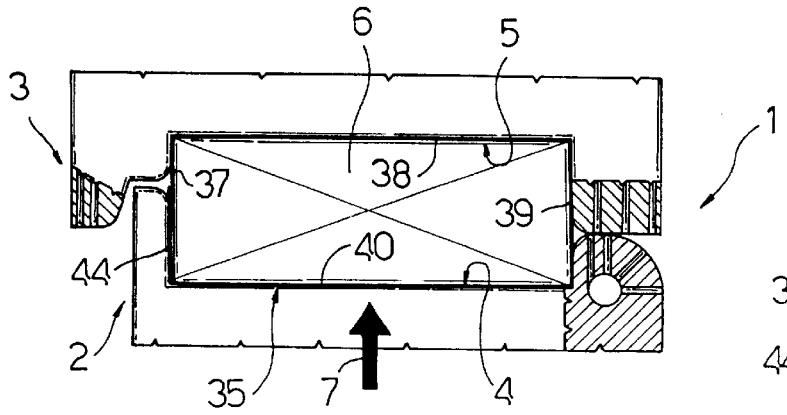
Figure 6A:
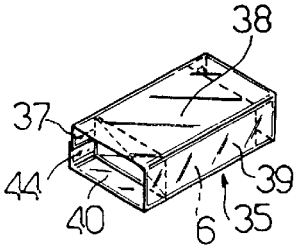
Figure 7:
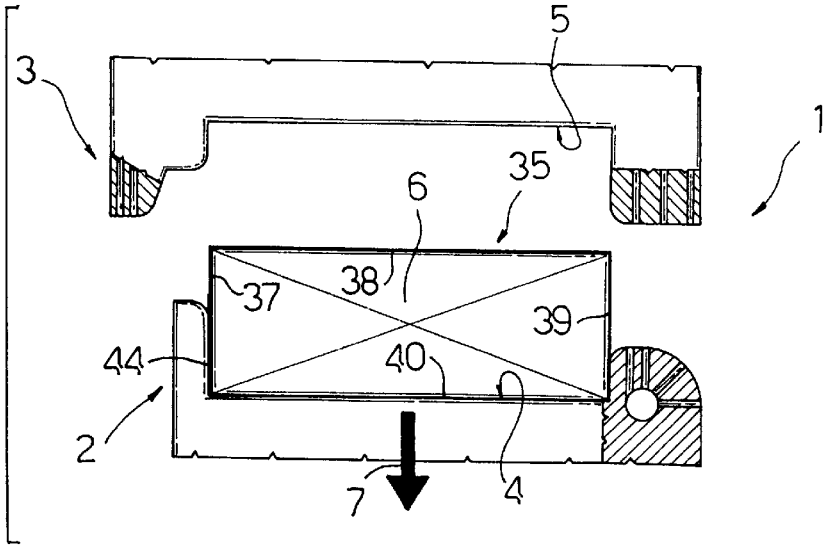

Numeral 1 in FIGS. 1 to 7 indicates a manipulating unit comprising at least a pair of pockets 2 and 3 defining respective seats 4 and 5 with their concavities facing each other, and each for partly receiving a product comprising, in the example shown, a packet 6 of cigarettes. By means of known actuating members (not shown), pockets 2 and 3 are movable, in relation to each other and in a direction 7, to and from a mating position (FIG. 2) in which seats 4 and 5 define a chamber 8 having a section similar in shape to but no smaller than an end surface 9 of packet 6.

Pocket 2 is substantially U-shaped with its concavity facing pocket 3, and comprises a bottom wall 10 having a surface 11 perpendicular to direction 7 and forming the bottom surface of seat 4 for supporting a large lateral surface 12 of packet 6. Pocket 2 also comprises two wings 13 and 14 extending parallel to direction 7 from wall 10 towards pocket 3, and having respective facing surfaces 15 and 16 defining the lateral surfaces of seat 4 for laterally supporting respective small lateral surfaces 17 of packet 6. More specifically, the length, measured in direction 7, of surfaces 15 and 16 is less than the width of respective surfaces 17, so that packet 6, when housed inside seat 4, projects partly outwards of seat 4.

Pocket 2 also comprises known mechanical and/or pneumatic devices (not shown) for releasably retaining packet 6 inside seat 4 and contacting surface 11.

Wing 14, measured in direction 7, is shorter than wing 13, and has a free end defined by a curved surface 18 at which open out a number of suction channels 19 extending substantially radially outwards from a suction header 20 formed through wing 14, crosswise to direction 7 and parallel to surfaces 11 and 16.

Like pocket 2, pocket 3 is substantially U-shaped with its concavity facing pocket 2, and comprises a bottom wall 21 having a surface 22 parallel to and facing surface 11 and forming the bottom surface of seat 5 for supporting a large lateral surface 23 of packet 6 parallel to surface 12. Pocket 3 also comprises two wings 24 and 25 extending parallel to direction 7 from wall 21 towards pocket 2, and having respective facing surfaces 26 and 27 defining the lateral surfaces of seat 5 for laterally supporting respective small lateral surfaces 17 of packet 6. More specifically, the length, measured in direction 7, of surfaces 26 and 27 is less than the width of respective surfaces 17 and is substantially complementary to the length of corresponding surfaces 15 and 16.

Like pocket 2, pocket 3 also comprises known mechanical and/or pneumatic devices (not shown) for releasably retaining packet 6 inside seat 5 and contacting surface 22.

Wing 24, measured in direction 7, is shorter than wing 25, and has a free end defined by a substantially flat surface 28, from the outer end of which a rib 29 projects towards pocket 2 and defines, with surface 28, a recess 30, which is engaged by the end of wing 13 when pockets 2 and 3 are set to the mating position. Rib 29 and wing 25 are defined on their free ends by respective surfaces 31 and 32, which are coplanar with each other and parallel to surface 22, and comprise respective suction holes 33 and 34 connected in known manner to a known suction device (not shown).

FIGS. 1 to 7 show how unit 1 is used to form, about packet 6, a tubular wrapping 35 (FIG. 6*b*) commencing with a flat sheet 36 of overwrapping material.

As shown in FIG. 1, to begin with, pockets 2 and 3 are set to the parted position facing each other; packet 6 is housed inside seat 4; and, by means of suction through holes 33 and 34, sheet 36 is retained extended in front of the opening of seat 5.

Subsequently (FIG. 2), pockets 2 and 3 are moved in relation to each other and in direction 7 into the mating position, in which surface 18 of wing 14 substantially contacts surface 32 of wing 25 with sheet 36 in between, and an end portion of wing 13 engages recess 30 to define chamber 8 housing packet 6. In the course of the above movement into the mating position, the portion of packet 6 projecting outwards of seat 4 is inserted inside seat 5 to fold sheet 36 into a U, so that an end portion 37 of the sheet, of a length greater than half the thickness of packet 6 and substantially equal to that of wing 24, contacts respective surface 17; a first portion 38 contacts surface 22; a second portion 39 contacts surface 27; and a third portion 40 extends outwards of chamber 8, between surfaces 18 and 32.

Subsequently (FIG. 3), the pockets are separated in direction 7 back into the parted position shown in FIG. 1, and packet 6 is released from seat 4 of pocket 2 and retained inside seat 5 of pocket 3.

During this movement, the suction through holes 34 is cut off, and suction through channels 19 is activated so that portion 40 slides in contact with surface 18 into a position substantially parallel to direction 7 and crosswise to a channel 41 defined between pockets 2 and 3 in the parted position.

As shown in FIGS. 3 and 4, unit 1 comprises a folding device 42 located along channel 41, and which, following relative displacement of pockets 2 and 3 and of folding device 42 itself in a direction 43 crosswise to direction 7, folds portion 40 squarely on to surface 12 of packet 6, with an end portion 44 (FIGS. 4 and 5) projecting from surface 12 and facing surface 31 of rib 29.

Subsequently, pockets 2 and 3 are moved back into the mating position (FIG. 6) so as to fold portion 44 squarely and overlap portion 37 to complete wrapping 35, and are then moved back into the parted position. Prior to the latter movement, packet 6 and wrapping 35 are released by pocket 3 and retained inside pocket 2, so that, at the end of the manipulating operation (in this case, the formation of wrapping 35), packet 6 is restored to its original position, at the start of the manipulating operation, inside seat 4.

Figure 8:
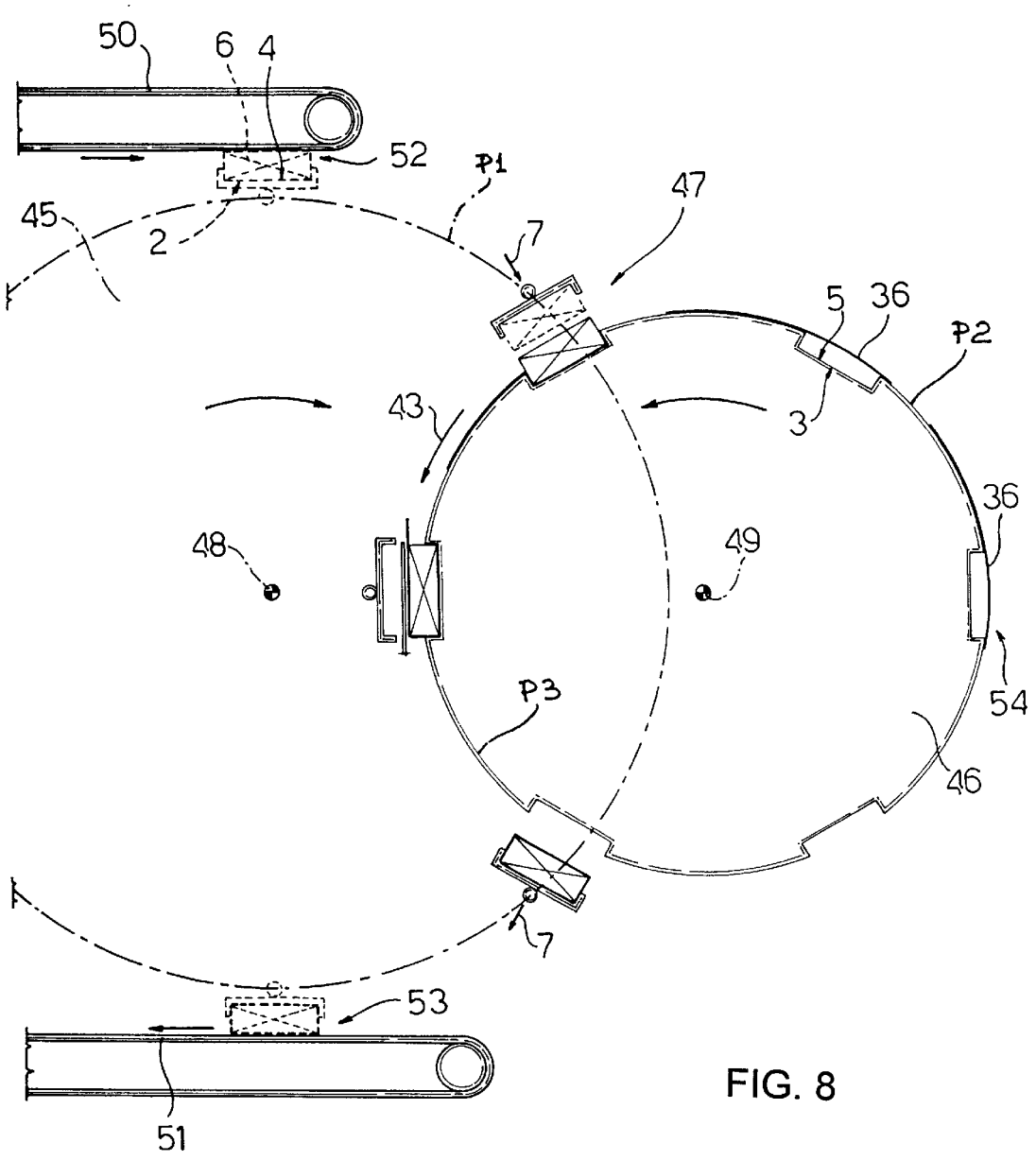
FIG. 8 shows a schematic side view of a conveying device comprising a number of manipulating units as shown in FIGS. 1 to 7.

The practical embodiment shown in FIG. 8 features a succession of pockets 2 and a succession of pockets 3 fitted to respective wheels 45 and 46 of a conveying device indicated as a whole by 47. Wheels 45 and 46 rotate in opposite directions about respective parallel axes 48 and 49 to feed pockets 2 and 3 along respective annular paths P1 and P2. More specifically, path P2 is a circular path, and wheel 45 is so formed as to move pockets 2 in known manner in direction 7 to deform path P1 and permit each pocket 2 to travel along a path P3, common to paths P1 and P2, in time with a respective pocket 3 and in direction 43.

In the practical embodiment shown in FIG. 8, wheel 45 is tangent to a loading conveyor 50 at a loading station 52 where packets 6 are loaded into seats 4, and to an unloading conveyor 51 at an unloading station 53 where packets 6 are unloaded from seats 4. Stations 52 and 53 are located along path P1 on either side of path P3, and, upstream from path P3 in direction 43, path P2 extends through a loading station 54 where sheets 36 are loaded onto pockets 3.

Each pair of corresponding pockets 2 and 3 defines a manipulating unit 1 for manipulating a respective packet 6, as described above, as it travels along path P3 in direction 43, and by moving pocket 2 in relation to respective pocket 3 in direction 7. In the FIG. 8 embodiment, folding device 42 is obviously located in a fixed position along path P3.

As will be obvious from the above description relative to FIGS. 1 to 7, two successive operations—in this case, folding operations—are performed on packet 6 with no need for movable tools on pockets 2 and 3, as packet 6 is transferred from seat 4 to seat 5 and back again to seat 4.

Figure 9:
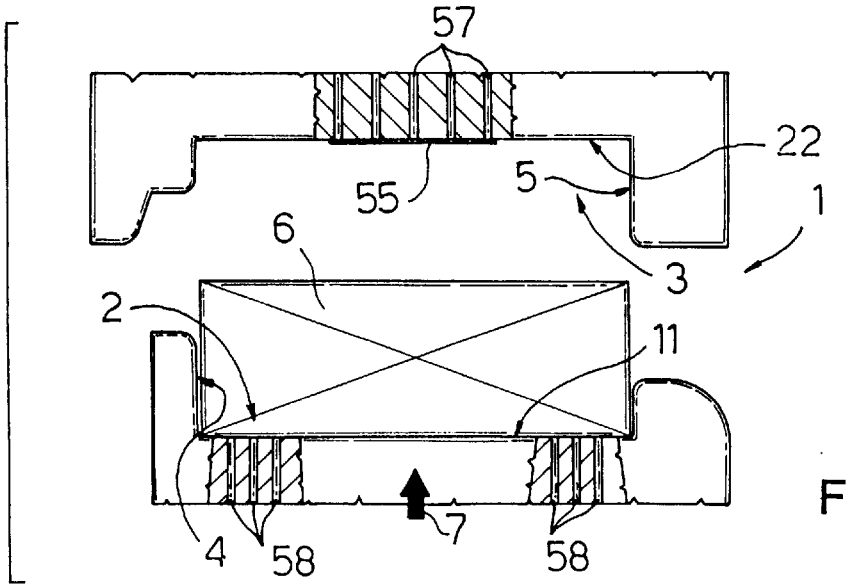
FIGS. 9 to 11 show the same view as in FIG. 1 of the FIG. 1 unit in three positions of a further operating sequence.
Figure 10:
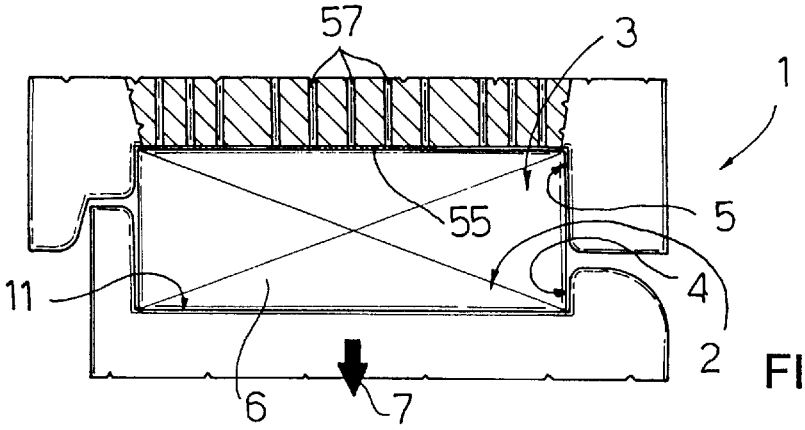
Figure 11:
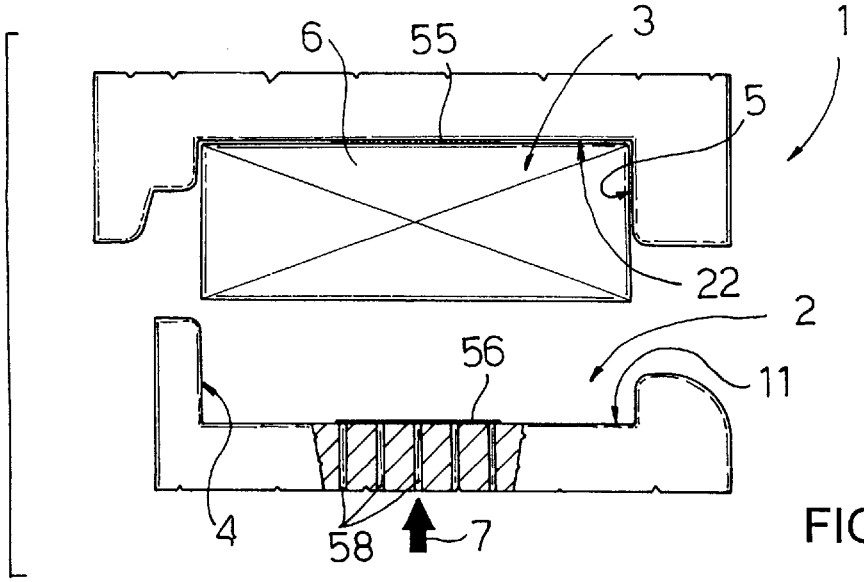

As shown in FIGS. 9 to 11, the movements of pockets 2 and 3 in direction 7 may be exploited for performing different operations, such as applying to surfaces 12 and 23 of packet 6 two labels 55 and 56 fed onto and retained on surfaces 22 and 11 at the two steps in which pockets 2 and 3 are set to the parted position.

What is claimed is:

1. A method of manipulating products (2), the method comprising the steps of supporting a product (6) by means of a first seat (4) facing and parallel to a second seat (5), the two seats (4, 5) being set to a parted position; moving the two seats (4, 5), in a first given direction (7), in relation to and towards each other into a mating position to transfer the product (6) from the first (4) to the second (5) seat and, at the same time, perform a first operation on the product (6); retaining the product (6) in the second seat (5); and moving the two seats (4, 5) in relation to each other so as to move the first seat (4) away from the second seat (5) and restore the two seats (4, 5) to the parted position; characterized by comprising the further step of moving the two seats (4, 5) in relation to each other and back into the mating position, so that the product (6) is engaged by the first seat (4), to perform a second operation on the product (6).

2. A method as claimed in claim 1, characterized by comprising the further steps of transferring the product (6)

from the second (5) to the first (4) seat when the two seats (4, 5) are once more in the mating position; retaining the product (6) inside the first seat (4); and moving the two seats (4, 5) back into the parted position.

3. A method as claimed in claim 1, characterized in that said two seats (4, 5) are moved in a second direction (43), substantially perpendicular to said first direction (7), and along a substantially common path (P3) in the course of said relative displacements of the two seats (4, 5) and said two operations.

4. A method as claimed in claim 1, characterized in that said first and said second operation involve mating the product (6) with at least one sheet element (36; 55, 56).

5. A method as claimed in claim 4, characterized in that said sheet element is a sheet (36) of wrapping material, which is fed between the two seats (4, 5) when the seats (4, 5) are in the parted position; said operations being w rapping operations for folding said sheet (36) about the product (6) and forming, in two successive steps, a tubular wrapping (35) about the product (6).

6. A method as claimed in claim 5, characterized in that said seats (4, 5) are substantially U-shaped; said first operation comprising folding said sheet (36) so as to obtain a sheet (36) folded substantially into a U about the product (6); said U-folded sheet (36) being obtained by at least partly inserting the product (6) and the sheet (36) inside the second seat (5) as said two seats (4, 5) are moved into the mating position.

7. A method as claimed in claim 6, characterized in that a portion (40) of said U-folded sheet (36) projects from the second seat (5) substantially in said first direction (7); said portion (40) of the sheet (36) being folded in a second direction (43) substantially perpendicular to the first direction (7), and at least partly onto the product (6) by external folding means (42) movable in relation to said two seats (4, 5), when the product (6) is housed in said second seat (5) and the two seats (4, 5) are in the parted position.

8. A method as claimed in claim 7, characterized in that, upon said portion (40) of the sheet being folded onto the product (6) by said folding means (42), an end portion (44) of said portion (40) of the sheet projects from the product (6) in said second direction (43); said second operation comprising folding said end portion (44) in said first direction (7) and onto the product (6) to obtain said tubular wrapping (35); said end portion (44) being folded by at least partly inserting the product (6) and the sheet (36) inside the first seat (4) as said two seats (4, 5) are moved into the mating position.

9. A method as claimed in claim 4, characterized in that said sheet element (55, 56) is a label (55; 56), which is fed between the two seats (4, 5) when the seats (4, 5) are in the parted position.

* * * * *